US007676978B2

(12) United States Patent
Marlatt

(10) Patent No.: US 7,676,978 B2
(45) Date of Patent: Mar. 16, 2010

(54) VEHICULAR GUN REST

(76) Inventor: Jerry D. Marlatt, 2982 FM 1540, Sandia, TX (US) 78383-5642

( * ) Notice: Subject to any disclaimer, the term of this patent is extended or adjusted under 35 U.S.C. 154(b) by 19 days.

(21) Appl. No.: 12/074,626

(22) Filed: Mar. 4, 2008

(65) Prior Publication Data

US 2009/0223106 A1 Sep. 10, 2009

(51) Int. Cl.
*F41A 23/28* (2006.01)

(52) U.S. Cl. ..... 42/94

(58) Field of Classification Search ..... 42/94; 211/64, 48; 224/401
See application file for complete search history.

(56) References Cited

U.S. PATENT DOCUMENTS

| | | | | | |
|---|---|---|---|---|---|
| 553,614 | A | * | 1/1896 | Handloser | 224/442 |
| D33,645 | S | | 12/1900 | Thorn | |
| 2,143,900 | A | | 1/1939 | Rarey | |
| D182,146 | S | | 2/1958 | Sharp | |
| 3,584,821 | A | | 6/1971 | Glebe | |
| D222,368 | S | | 10/1971 | Smith | |
| 4,144,971 | A | * | 3/1979 | Balibrea | 211/64 |
| 4,481,964 | A | * | 11/1984 | Minneman | 135/66 |
| D276,668 | S | * | 12/1984 | Minneman | D3/7 |
| 4,607,772 | A | * | 8/1986 | Hancock | 224/442 |
| 4,682,720 | A | * | 7/1987 | Lucas | 224/311 |
| 5,644,862 | A | | 7/1997 | Folmer | |
| 5,680,939 | A | * | 10/1997 | Oliver | 211/64 |
| 5,697,181 | A | * | 12/1997 | Savant | 42/94 |
| 5,723,808 | A | | 3/1998 | Devall | |
| 5,819,462 | A | * | 10/1998 | Dockery | 42/94 |
| 5,974,719 | A | | 11/1999 | Simonek | |
| 6,142,349 | A | * | 11/2000 | Roberson | 224/401 |
| 6,338,218 | B1 | | 1/2002 | Hegler | |
| 6,484,913 | B1 | * | 11/2002 | Hancock et al. | 224/401 |
| 6,634,530 | B1 | * | 10/2003 | Black | 224/401 |
| 6,793,108 | B2 | | 9/2004 | Williams, Jr. | |
| 6,935,065 | B1 | * | 8/2005 | Oliver | 42/94 |
| 7,066,366 | B2 | * | 6/2006 | Hancock et al. | 224/401 |
| 7,493,719 | B2 | * | 2/2009 | Lackey | 42/94 |
| 2005/0188595 | A1 | | 9/2005 | Lackey | |

* cited by examiner

*Primary Examiner*—Michael Carone
*Assistant Examiner*—Reginald Tillman, Jr.
(74) *Attorney, Agent, or Firm*—G. Turner Moller

(57) ABSTRACT

A hunting vehicle incorporates a roll cage having a tubular frame member. A gun rest incorporates a standard mounted on the tubular frame member and provides a support moveable up and down on the standard between a plurality of supporting positions. The standard is mounted on the frame member so a hunter may place a rifle on the support to steady the hunter's aim. The standard is mounted on the tubular member for easy rotation by the hunter so the hunter may aim in a wide arc without unfastening or loosening any fasteners and without moving the vehicle.

12 Claims, 2 Drawing Sheets

Fig.5
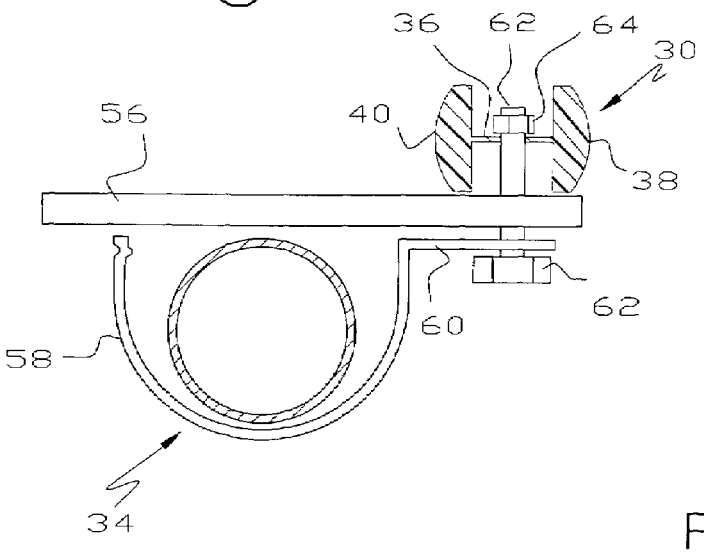
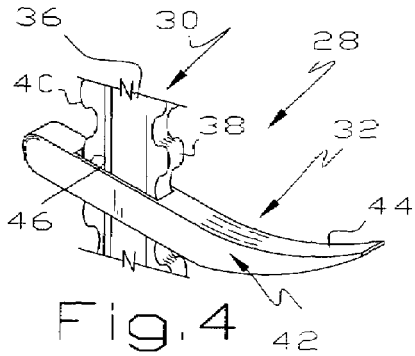
Fig.4
Fig.3
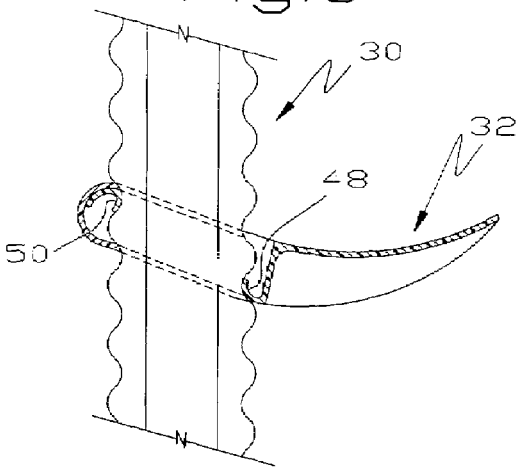
Fig.2
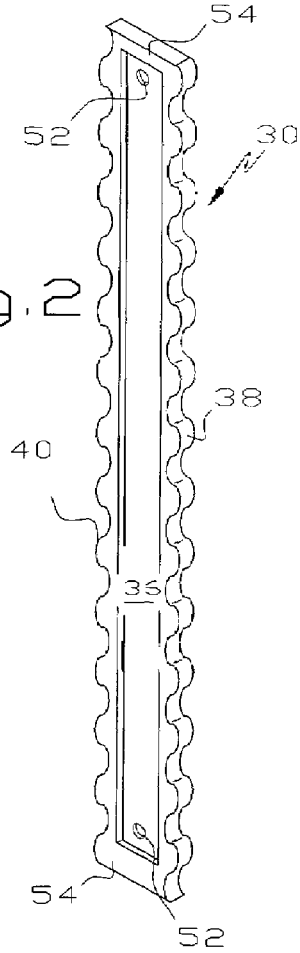

VEHICULAR GUN REST

This invention relates to a gun rest which may be attached to a vehicle.

BACKGROUND OF THE INVENTION

A gun rest is an implement used to steady a rifle in an attempt to deliver accurate fire. Many gun rests are designed for range firing and others are designed for hunters. Typical hunter's gun rests have a vertical stake which is pushed into the ground and provides a support extending perpendicular to the stake to receive the rifle stock. Although there are many such gun rests, there are very few gun rests which are attached to motorized vehicles, such as all terrain vehicles. Some all terrain vehicles are smallish vehicles steered with handle bars like motorcycles and are often known as ATV's. Similar larger vehicles are more analogous to small cars and are known as UTV's or UV's. Although there are some gun cases or holsters suited for smaller type ATV's, there is a dearth of gun rests which are particularly adapted for larger type utility vehicles, to which this invention most nearly relates.

Disclosures of interest are found in U.S. Pat. Nos. 2,143,900; 3,584,821; 4,481,964; 5,644,862; 5,697,181; 5,723,808; 5,974,719; 6,338,218; 6,634,530; 6,793,108; D33,645; D182,146; D222,368 and D276,668 and U.S. Printed Application 2005/0188,595.

SUMMARY OF THE INVENTION

In this invention, a gun rest is attached to a round tubular member of a larger type all terrain vehicle such as a Kawaski Mule, a John Deere Gator HPX Series, a Polaris Ranger or the like.

Specifically, the gun rest is secured to a round tubular member comprising part of the roll cage of the all terrain vehicle. An important feature of the gun rest of this invention is its ability to rotate easily about the axis of the tubular member so the gun support may be swung in a wide arc. This means the shooter has the ability to swing the gun rest in a wide arc from any position to a firing position without loosening or adjusting any fastener and without moving the vehicle. In preferred embodiments of this invention, the gun rest may rotate 360° about the axis of the tubular roll cage member so the shooter has the ability to fire a rifle in almost any direction.

In a preferred embodiment, the gun rest comprises an upright or standard having wavy or serrated edges and the gun support provides a slot receiving the upright and exposing end faces to the serrations as shown in U.S. Pat. No. 4,481,964. This arrangement is particularly well suited for mounting on a vehicle because driving over rough terrain shortly causes the gun support to ratchet down to its lowermost position so it rattles for only a short length of time. When in its lowermost position, it does not rattle on the vehicle regardless of how rough the terrain being driven over.

It is an object of this invention to provide an improved gun rest which may be attached to an all terrain vehicle.

Another object of this invention is to provide a gun rest for attachment to a vehicle roll cage in such a way that the gun rest may be rotated to support a rifle in a wide aiming arc.

A further object of this invention to provide a combination gun rest and vehicle to provide a better hunting experience.

These and other objects and advantages of this invention will become more fully apparent as this description proceeds, reference being made to the accompanying drawings and appended claims.

BRIEF DESCRIPTION OF THE DRAWINGS

FIG. 2 is a side elevational view of a standard or column of a gun rest of this invention;

FIG. 3 is a view, partly in section, showing the gun support and how it cooperates with the standard of FIG. 2;

FIG. 4 is an isometric view similar to FIG. 3;

FIG. 5 is a top view of a mounting bracket of this invention which secures the gun rest to the vehicle while allowing easy rotation of the gun rest without removing or loosening any fasteners.

DETAILED DESCRIPTION OF THE INVENTION

Figure 1:
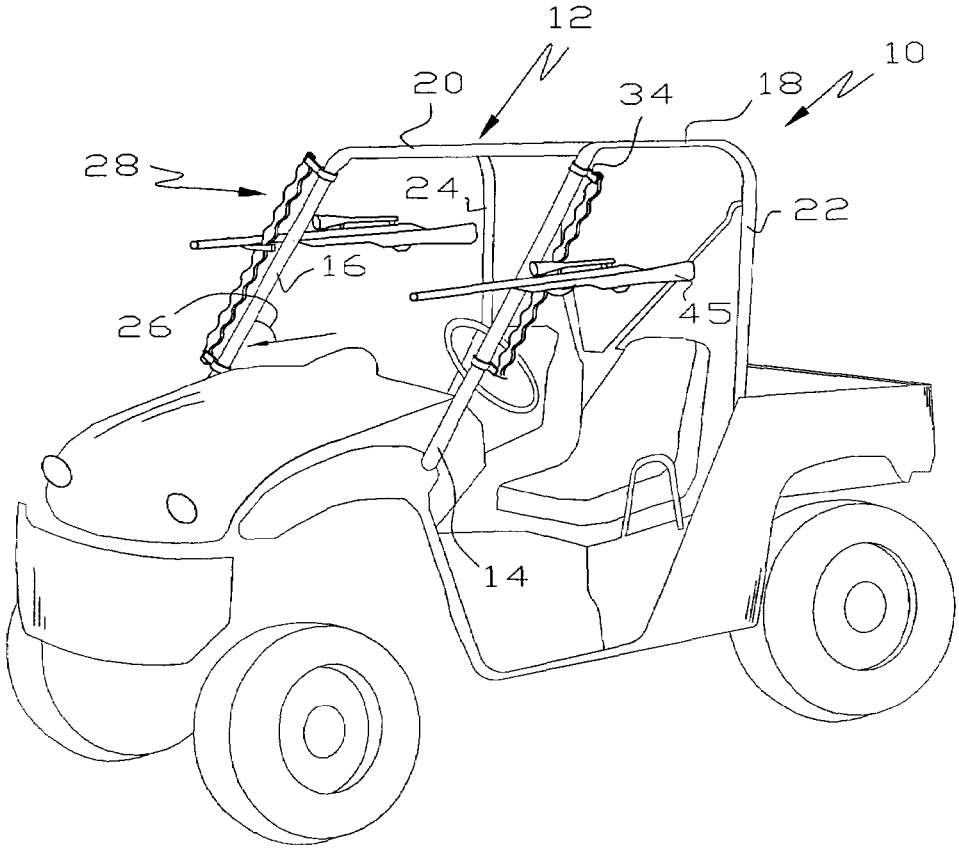
FIG. 1 is an isometric view of a vehicle having the gun rest of this invention attached thereto.

Referring to FIGS. 1-6, there is illustrated a gun rest 10 of this invention attached to a roll cage 12 of an all terrain self propelled vehicle of a type used in hunting, such as a Kawasaki Mule, a John Deere Gator HPX Series, a Polaris Ranger or the like. The roll cage 12 is made of round tubing, typically 1½" O.D. and includes a pair of rearwardly inclined tubular sections 14, 16 which are analogous to the windshield line of conventional automobiles. The inclined tubular sections 14, 16 are welded to or are bent into horizontal tubular sections 18, 20 and vertical sections 22, 24 which are joined to the vehicle 10 to provide a sturdy protective cage around the occupants of the vehicle 10, all in a conventional manner. Those skilled in the art will recognize that the inclined tubing sections 14, 16 are inclined at an acute angle 26 relative to the forward direction of movement of the vehicle 10.

The gun rest 28 of this invention comprises, as major components, a standard or column 30, a gun support 32 movable up and down on the standard 30 and an attachment 34 securing the standard 30 to the vehicle 10 to allow the standard 30 to be rotated in a significant arc without having to unfasten, loosen or tighten any fasteners. It will be apparent that the gun rest 28 may be mounted on either or both of the inclined tubing sections 14, 16 or on either or both of the vertical tubing sections 22, 24, as will be explained more fully hereinafter. Also as will be more fully apparent hereinafter, the components of this invention are commercially available devices or somewhat modified commercially available devices and thus are subject to wide variation.

The standard or column 30 may be of any suitable type and is illustrated as of a preferred type made of any suitable material, such as an organic polymer or plastic. The standard 30 is generally H-shaped in cross-section as shown in FIG. 5 and comprises a central web 36 and wavy or corrugated edges 38, 40. The gun support 32 extends perpendicularly to the standard 30 and provides a body 42 having a curved top surface 44 on which a rifle or other firearm 45 rests during firing. The body 42 provides a slot 46 receiving the standard 30 as shown best in FIG. 4. Curved leading and trailing edges 48, 50 exposed to the slot 46 cooperate with the wavy edges 38, 40 so the support 32 can be raised or lowered on the standard 30 in a simple, expeditious manner, as by tilting the support 32 relative to the standard 30 and thereby disengaging the edges 48, 50 from the standard 30. With the edges 48, 50 disengaged, the support 32 moves easily up and down. Those skilled in the art will recognize the standard 30 and gun support 32, as heretofore described, as being patterned after a commercially available hunter's gun rest from MTM Molded Products Company of Dayton, Ohio and as disclosed in U.S. Pat. No. 4,481,964, to which reference is made for a more complete description thereof.

The commercially available standard 30 is conveniently modified to provide passages 52 for fasteners, as will be explained more fully apparent hereinafter, and to provide strengthening ribs 54, as desired, at the top and bottom of the standard 30.

Although the attachment 34 is of a commercially available type, it has an important and novel function in this invention because it allows rotation of the gun rest 28 about an axis of the tubing section on which it is mounted without requiring adjustment, tightening or loosening of any fastener. To this end, the attachment 34 comprises a conventional clamp, known in the trade as an EMT clamp, EMT meaning electrical metallic tubing. The clamp 34 comprises a relatively thick rigid plate 56, a generally C-shaped bracket 58 having an apertured flange or tail 60 through which extends a bolt 62 secured in place by a nut 64. Those skilled in the art will recognize the clamp 34 as being of the type used to secure electrical conduit to a wall or support so that electric cable can later be threaded through the conduit and supported.

An important feature of this invention is the clamp 34 secures the gun rest 28 to its tubing section sufficiently tightly that the clamp 34 does not slip downwardly on the tubing section in response to a hunter placing the rifle 46 on the gun support 32 or in response to the vehicle driving over rugged terrain. Conversely, the clamp 34 secures the gun rest 28 to its tubing section sufficiently loosely that the clamp 34 easily rotates around the round tubing section to which it is mounted. Clearly, if the clamp 34 is not tightened sufficiently, the gun support 32 will slip downwardly on the tubing section. If the gun support 32 is tightened too much, it will not rotate easily on the tubing section to which it is attached.

One convenient way to quantitatively determine the parameters necessary to attach the gun rest 28 to the roll cage 12 is to measure the amount of force necessary to rotate the clamps 34 on the tubing section to which it is attached. A simple way to do this is to tie one end of a string to the gun rest 28 and the other end to a fish scale such as available from Laker Corporation of Comdenton, Missouri and pull on the fish scale to see how much force it takes to rotate the clamps 34 on the tubing section. If it takes less than about six pounds to rotate the clamps 34, the clamps 34 are not tightened sufficiently and the gun rest 28 will not adequately support the rifle 46 when it is aimed or will slip downardly during travel over rough terrain. If it takes more than fifty pounds to rotate the clamps 34, they are tightened too tight, cannot readily be adjusted by the hunter and have the potential to damage the roll cage tubing 14, 16. Preferably, the fastener 62, 64 is tightened so it takes about ten to twenty pounds force to rotate the gun rest 28 on the tubing section 14, 16 and ideally, it takes about 15 pounds force.

Figure 6:
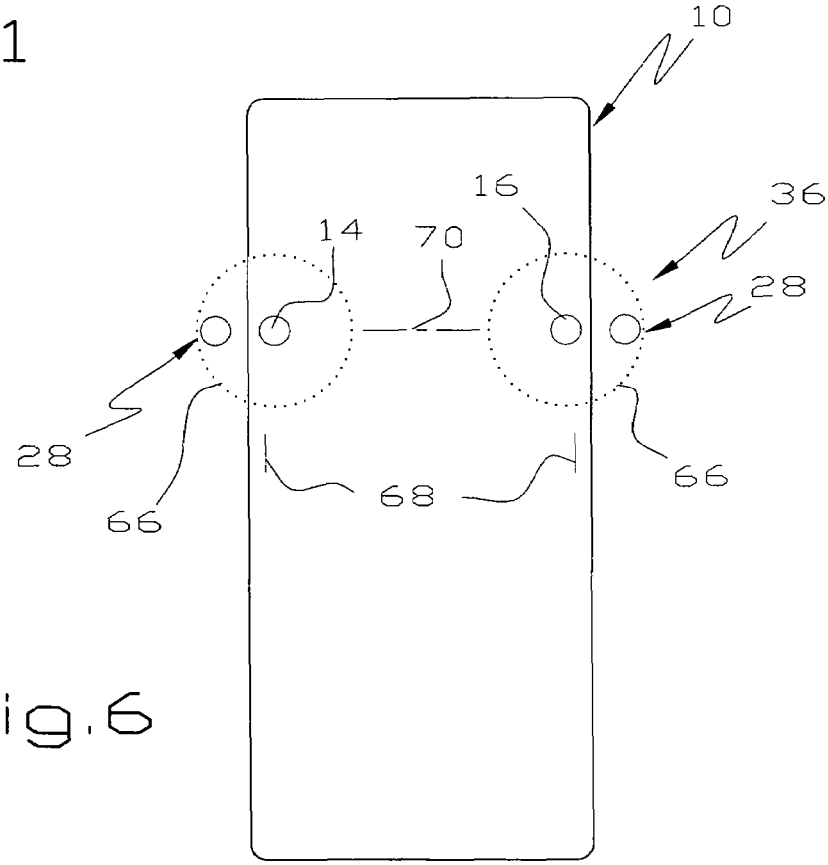
FIG. 6 is a schematic view of a vehicle equipped with a gun rest of this invention illustrating the firing arc allowed by this invention.

An important feature of this invention is that the gun rest 28 may be rotated through a significant arc relative to the vehicle 10 as shown best in FIG. 6. As shown in the dotted circles 66, the gun rests 28 are rotatable for 360° about the tubing sections 14, 16 allowing the hunter to aim in any direction. In the event the vehicle 10 were to have a closed cab, the gun rests 28 would be rotatable for an arc of about 270°, i.e. from adjacent a door 68 represented by a dashed line to adjacent a windshield 70.

Use of the gun rest 28 should now be apparent. The hunter first decides which tubing section or sections the gun rest 28 will be mounted on. Conveniently, one or both of the inclined tubing sections 14, 16 is selected. The clamps 34 are attached to each end of the standard 30 and to the inclined tubing section and the fastener 62, 64 tightened as discussed above. When the vehicle 10 is driven along rough terrain, the gun support 32 initially bounces up and down and gravitates to the bottom of the standard 30 where it quits rattling. When the hunter sees something to shoot at, the vehicle is stopped. The standard 30 is rotated on the tubing section 14, 16 and the gun support 32 is raised along the standard 30 until it is at a desired height until the rest is at a position that is comfortable relative to the point being aimed at. The rifle 46 is placed on the gun support 32 and fired at will.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A gun rest for attachment to a tubular roll cage member of an all terrain vehicle, comprising an elongate standard and a gun support, transverse to the standard, mounted for movement along the standard to adjust the height of the gun support on the standard;

at least a pair of clamps spaced apart on the elongate standard for receiving a tubular roll cage member therein for attaching the gun rest to an all terrain vehicle, wherein each clamp comprises a flat substantially rigid plate having a fastener opening adjacent one side and a C-shaped bracket having an apertured flange overlying the fastener opening; and a threaded fastener passing through the opening in the rigid plate, a hole in the C-shaped bracket and a hole in the elongate standard for both securing the clamp to the standard and constricting the clamp about the tubular roll cage member.

2. The gun rest of claim 1 wherein the standard comprises a series of serrations on opposite sides thereof and the support comprises an arm having a slot therein receiving the standard and providing complementary arcuate sections mating with the serrations.

3. The gun rest of claim 1 wherein the clamps are adjacent opposite ends of the standard.

4. In combination, an all terrain vehicle having a roll cage providing an upright round tubular member and a gun rest attached to the tubular member, the gun rest comprising an elongate standard and a gun support, perpendicular to the standard, mounted for movement along the standard to adjust the height of the gun support and at least two clamps spaced apart on the elongate standard and receiving the round tubular member therein and simultaneously allowing rotation of the clamp on the tubular member and restraining vertical movement of the standard relative to the tubular member.

5. The combination of claim 4 wherein the round tubular member is inclined at an acute angle relative to a forward direction of movement of the vehicle.

6. The combination of claim 4 wherein the standard has the capability of rotating on the tubular member upon the application of a force to the standard in the range of 6-50 pounds.

7. The combination of claim 5 wherein the force is in the range of 10-20 pounds.

8. The combination of claim 7 wherein the force is about fifteen pounds.

9. The gun rest of claim 4 wherein the standard comprises a series of serrations on opposite sides thereof and the support comprises an arm having a slot therein receiving the standard and providing complementary arcuate sections mating with the serrations.

10. The gun rest of claim 9 wherein the clamp comprises a flat substantially rigid plate having a fastener opening adjacent one side and a C-shaped bracket having an apertured flange overlying the fastener opening and a threaded fastener extending through the apertured flange and fastener opening.

11. The gun rest of claim 4 wherein the roll cage comprises a second upright tubular member generally parallel to the first mentioned upright tubular member and a second gun rest attached to the second tubular member, the second gun rest comprising a second elongate standard and a second gun support, perpendicular to the second standard, mounted for movement along the second standard to adjust the height of the second gun support and at least two second clamps spaced apart on the second elongate standard and receiving the second round tubular member therein and simultaneously allowing rotation of the second clamp on the second tubular member and restraining vertical movement of the second standard relative to the tubular member.

12. The combination of claim 4 wherein each clamp comprises a flat substantially rigid plate having a fastener opening adjacent one side and a C-shaped bracket having an aperatured flange overlying the fastener opening; and a threaded fastener passing through the opening in the rigid plate, a hole in the C-shaped bracket and a hole in the elongate standard for both securing the clamp to the standard and constricting the clamp about the tubular roll cage member.

* * * * *